United States Patent [19]

Norminton

[11] 4,312,496

[45] Jan. 26, 1982

[54] COMPACT CROSS SHAFT TYPE COMPOUND DRUM HOIST FOR SPOOLING EXTRA LONG LENGTHS OF TOW CABLE WITH SEGMENTED FAIRINGS

[75] Inventor: Robert S. Norminton, Niagara Falls, Canada

[73] Assignee: Fleet Industries, Ontario, Canada

[21] Appl. No.: 163,310

[22] Filed: Jun. 26, 1980

[30] Foreign Application Priority Data

Aug. 2, 1979 [CA] Canada ..... 333065

[51] Int. Cl.[3] ..... B66D 1/26

[52] U.S. Cl. ..... 254/302; 114/254; 242/54 R; 254/303

[58] Field of Search ..... 254/278, 293–322; 242/54 R; 114/243, 254

[56] References Cited

U.S. PATENT DOCUMENTS 2,802,638 8/1957 Ireland ..... 254/278 X
3,536,298 10/1970 Deslierres ..... 114/254
3,576,295 4/1971 Hale ..... 254/278 X
3,966,171 6/1976 Hale ..... 254/311 X

*Primary Examiner*—John M. Jillions
*Attorney, Agent, or Firm*—Weinstein & Sutton

[57] ABSTRACT

A novel compound drum hoist is provided herein. It includes a first or outer cable-spooling drum rotatably and drivingly mounted on a first shaft. A second or inner cable-spooling drum is nested within the first drum, and is rotatably and drivingly mounted on a second shaft disposed at an angle of 90°±30°, but preferably at a right angle to the first shaft. The inner drum is operable to be rotated while the outer drum is maintained stationary, thereby to spool faired cable onto the inner drum. Substantially simultaneously the outer drum is rotated along with the inner drum, thereby to spool faired cable onto the outer drum. Such hoist is thus suitably adapted to wind long lengths of cable with segmented fairings thereon without any significant risk of crushing the fairings.

20 Claims, 10 Drawing Figures

COMPACT CROSS SHAFT TYPE COMPOUND DRUM HOIST FOR SPOOLING EXTRA LONG LENGTHS OF TOW CABLE WITH SEGMENTED FAIRINGS

BACKGROUND OF THE INVENTION (i) Field of the Invention

This invention relates to means for spooling and/or storing faired cable aboard ship.

(ii) Description of the Prior Art

Underwater SONAR (abbreviated from "Sound Navigation and Ranging") is finding ever-increasing use in the fields of navigation, mapping, depth finding, fish finding, and detection of wrecks and enemy vessels. SONARS as used by surface vessels may be classified either as (1) hull mounted systems, wherein an underwater sound transducer or array is mounted on the hull of the vessel; or (2) variable depth systems, wherein an underwater sound transducer or array is mounted in a body towed from the vessel.

To be truly useful, a variable depth system must be capable of placing the towed vehicle with its enclosed array well below the thermocline layers in the ocean. This may mean towing with several thousand feet of cable. To obtain maximum depth with a given length of cable, cable drag is reduced by enveloping the entire length of cable with streamlined fairings. These fairings are segmented into short lengths with interconnecting links to allow bending or wrapping of the cable without fracturing the fairings.

A problem arises, however, in the spooling or storing of such a faired cable aboard ship. The tailpieces of the segmented fairings are almost always made of lightweight plastic, and it is not possible to spool the cable in multiple layers onto a drum without crushing the fairings in all but the top layer. This means that, in usual practice, only single-layer winding could be used with a segmented fairing cable. If the cable is very long, the winding drum may be huge. This would cause topside weight and space problems, fleet angle problems and might necessitate the use of extra power.

A number of methods of circumventing these problems have been proposed in the past. For example, U.S. Pat. Nos. 2,397,957 issued Apr. 9, 1946 to H. B. Freeman; 2,401,783 issued June 11, 1946 to K. H. Wilcoxon; 3,209,718 issued Oct. 5, 1965 to R. L. Rather et al; and 3,241,513 issued Mar. 22, 1966 to R. L. Rather et al, all attempt to solve the problem by the use of removable fairings. With such fairings, the base cable can be spooled as a multi-layer onto a storage drum. However, a major disadvantage is that time is consumed stripping the fairings on cable recovery and installing the fairings during cable payout. This could be particularly difficult in high sea states. A problem also arises in storing the removed fairings without damage.

Canadian Pat. No. 902,577 issued June 13, 1972 to N. E. Hale proposed to solve the problem by using multiple concentric drums. However, there are many disadvantages inherent in a drum of this construction. Firstly, the outer drums must be slotted across the face of the shell and this may severely weaken the drums. Secondly, the cable or fairings or both may be severely damaged at the points of inflection in bridging the shell gaps. Thirdly, in one embodiment, one drum is connected to the other by short-stroke hydraulic cylinders connected up to a manifold system with quick-release connections. Frequent use of this method aboard ship will result in hydraulic spills, and contamination being introduced into the hydraulic system. In another embodiment, the outer drum is given motive power by wedging up the tailpieces of the fairings into contact with the roof of an access chamber in the outer drum. This may damage and crush the fairings.

It has also been suggested to use two concentric drums with unbroken shell faces which screw into one another. The major disadvantage of such proposal was that with all the cable paid out, the drums must be completely unscrewed, and in this condition they take up as much space and weight as the one single layer drum previously referred to and with a great increase in complexity.

Another proposal is shown in Canadian Pat. No. 671,172 issued Sept. 24, 1963 to Nantec Corporation which provided a level winding device disposed at right angles to a cable storage drum. A key feature of this invention was the use of pressure rollers to exert a squeezing force on the cable. It is virtually impossible to exert such a force on cable enclosed with segmental fairings for the purpose of gaining traction. In addition, such squeezing force might damage the fairings, which are somewhat fragile.

Yet another proposal was shown in Canadian Pat. No. 671,172 issued June 18, 1974 to American Chain and Cable Co. Inc. which provided a cable trained over a double capstan, with its other end extending through a guide into a cylindrical container disposed at right angles to the capstan. Key features of this proposal were the use of separate traction and storage drums. The storage drum and its drive alone would take up as much space as a single simple powered drum used for both power and storage. In other words, and aside from other drawbacks, as a means of spooling extra long lengths of segmentally faired cable (all in one single layer), the traction winch with separate storage drum is the most space-consuming solution of all, and there would be no room for it aboard most naval vessels.

SUMMARY OF THE INVENTION (i) Aims of the Invention

Accordingly, a broad object of this invention is to provide a compound hoist specially adapted for winding long lengths of cable with segmented fairings thereon without any significant risk of crushing the fairings.

Another object of this invention is to provide such a compound hoist which does not cause topside weight and space problems aboard a ship.

(ii) Statement of the Invention

By this invention, a compound drum hoist is provided comprising: (a) a first cable-spooling drum rotatably and drivingly mounted on a first shaft; (b) a second cable-spooling drum nested within the first drum, and rotatably mounted on a second shaft disposed at an angle of $90° \pm 30°$ but preferably at right angles to the first shaft; (c) means for rotating the second drum while keeping the first drum stationary, thereby to spool faired cable onto the second drum; and (d) means for substantially simultaneously rotating the first drum along with the second drum, thereby to spool faired cable onto the first drum.

(iii) Other Features of the Invention

By a feature of this invention, the inner drum comprises a cylindrical drum rotatably mounted on a cross-shaft supported on bearings within the shell of the outer drum.

By another feature of this invention, the inner drum is driven by a bevel gear, meshing with a bevel pinion mounted on, or formed integral with, a drive shaft.

By another feature of this invention, the drive shaft is driven by a bull gear secured thereto, and is driven by a pinion which is, in turn, driven by a motor.

By still another feature of this invention, the motor includes a fail-safe brake.

By another feature of this invention, the inner drum is driven by a multiple gear set consisting of a combination of small parallel and bevel gears.

By yet another feature of this invention, the inner drum includes a spiral ramp at one end and a cable hause hole, a clamp and an electrical exit hole at the other end thereof.

By a further feature of this invention, the inner drum and/or the outer drum comprises a double conical drum, the inner drum being rotatably mounted on a cross-shaft supported on bearings within the shell of the outer drum.

By another feature of this invention, the gear shaft drive to the inner drum is supported on bearings mounted on a hub extending from a radial web of the outer drum.

By another feature of this invention, the outer drum comprises a cylindrical drum.

By a further feature of this invention, the outer drum is supported on bearings on a rim extension mounted in an outer housing, and on bearings on a hub thereof mounted on an inner housing, the housings being attached to a base.

By another feature of this invention, the gear shaft drive to the inner drum is driven by a bull gear secured thereto, and driven by a motor driven pinion.

By yet another feature of this invention, the outer drum is selectively driven by the same bull gear which is secured to the gear shaft drive and is driven by a pinion which itself is driven by a motor which, in turn, drives the inner drum.

By a further feature of this invention, the means for rotating the outer and inner drums includes means for positively locking the inner drum to the hub of the outer drum before the drive means for the outer drum can be driven.

By another feature of this invention, the means for rotating the outer and inner drums comprises a clutch lock-out coupling selectively actuatable to cause (a) either the inner drum alone, or (b) both the inner drum and the outer drum to be driven together.

By a further feature of this invention, the clutch lock-out coupling includes external splines adapted to be in constant engagement with internal splines on the hub of the outer drum; internal splines adapted selectively to engage external splines in drive shaft for the inner drum; external splines adapted to engage internal splines in a hold back structure; and an actuatable yoke linkage to cause the splines in the clutch lockout coupling to engage respective splines, thereby to cause (a) either the inner drum alone, or (b) both the inner drum and the outer drum to be driven together.

By another feature of this invention, the yoke linkage is adapted to be actuated by a hydraulic cylinder mounted to the housing, thereby to move an axially movable coupling member.

By still another feature of this invention, the outer drum includes a notched portion and a spout or ramp with a guard thereon just below the notched portion, thereby to guide faired cable between the inner drum and the outer drum.

BRIEF DESCRIPTION OF THE INVENTION

In the accompanying drawings.

Figure 10:
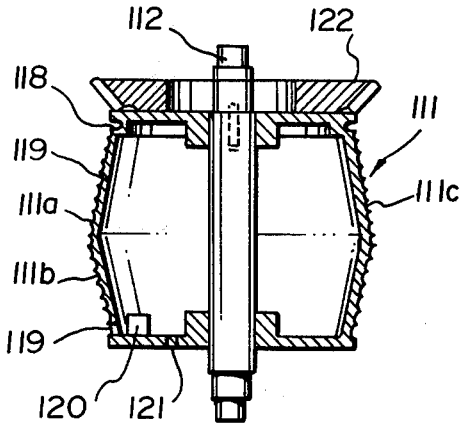

FIGS. 6, 7, 8 and 9 all show, in schematic form, various stages of winding faired cable on the nested drums of the hoist of an aspect of this invention; and FIG. 10 is a section of an alternative drum design which may be used for the second and/or the first drum.

Figure 1:
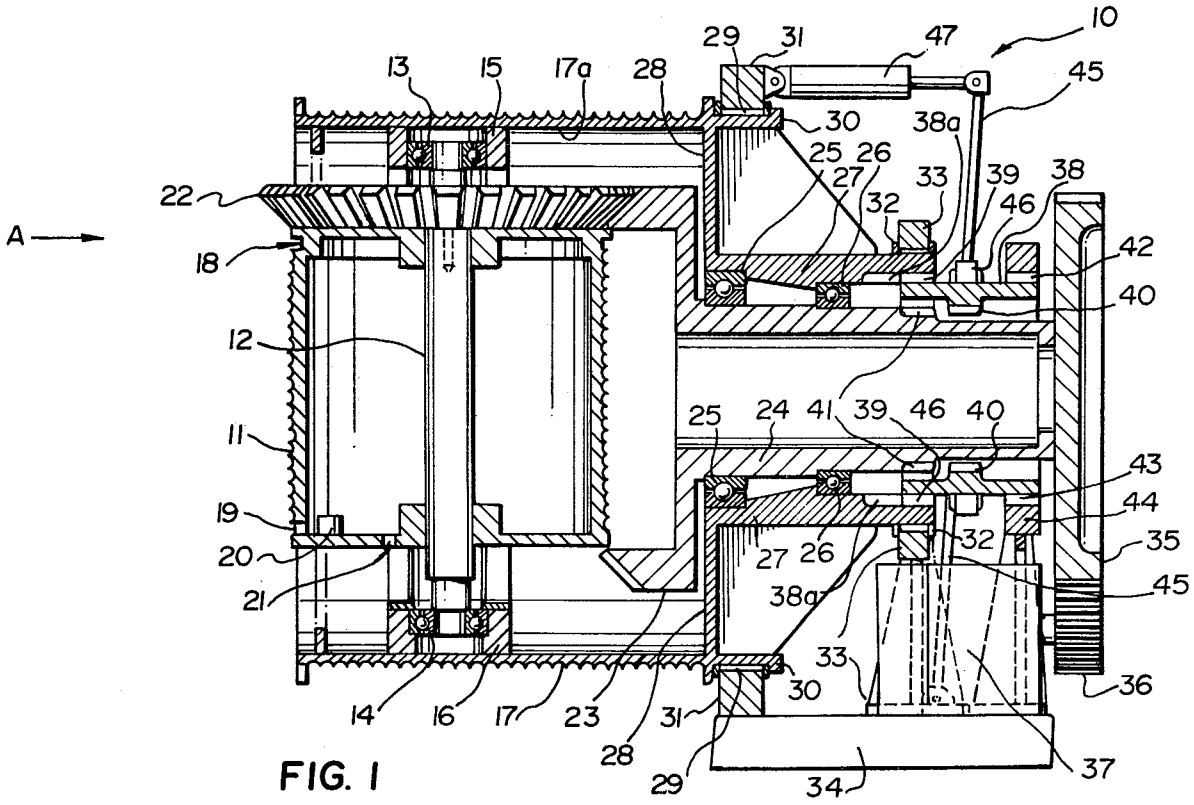
FIG. 1 is a central section through the hoist of one embodiment of this invention showing the first drum and the second drum nested therewithin.

DESCRIPTION OF PREFERRED EMBODIMENTS (i) Description of FIG. 1

As seen in FIG. 1, the hoist 10 includes an inner or second drum 11 mounted on cross-shaft 12 which is supported in sealed bearings 13 and 14 mounted in housings 15 and 16 within the shell 17*a* of the outer or first drum 17. The inner drum 11 has a spiral ramp 18 at one end thereof and a cable hause hole 19, a clamp 20 and an electrical exit hole 21 at the other end thereof. In the embodiment as shown the inner drum 11 is driven by bevel gear 22 which meshes with bevel pinion 23. Pinion 23 is mounted on, or formed integral with, shaft 24, which may be hollow. Shaft 24 is supported in sealed bearings 25 and 26 which, in turn, are mounted in a large reinforced hub 27 extending from web 28 at one end of the outer drum 17. The outer drum 17, in turn, is supported in a large bearing 29 bearing on rim extension 30 and mounted in housing 31, and a smaller bearing 32 bearing on hub 27 and mounted in housing 33. Both housings 31 and 33 are attached to base 34. A bull gear 35 is attached to the end of shaft 24 opposite bevel gear 23. This gear 35 is driven by pinion 36 mounted on motor and brake assembly 37, which also is attached to base 34. This motor and brake assembly 37 may be a hydraulic or electric motor with a fail-safe brake, and additional gearing (not shown) may be interposed between motor 37 and pinion 36 if required. A multi-purpose clutch lockout coupling 38 has external splines 38*a* which are adapted to be in constant engagement with internal splines 39 cut into the end of hub 27. This coupling 38 also has internal splines 40 which can engage external splines 41 cut onto the outside of shaft 24, and a further set of external splines 42 which can engage internal splines 43 cut into hold-back structure 44, which is also attached to base 34. The multi-purpose clutch lockout coupling 38 is adapted to be engaged or disengaged by yoke linkage 45 attached to collar 46 which runs on the outside diameter of coupling 38. One end of linkage 45 is attached to hydraulic cylinder 47, which in turn is mounted to the housing 31.

Figure 2:
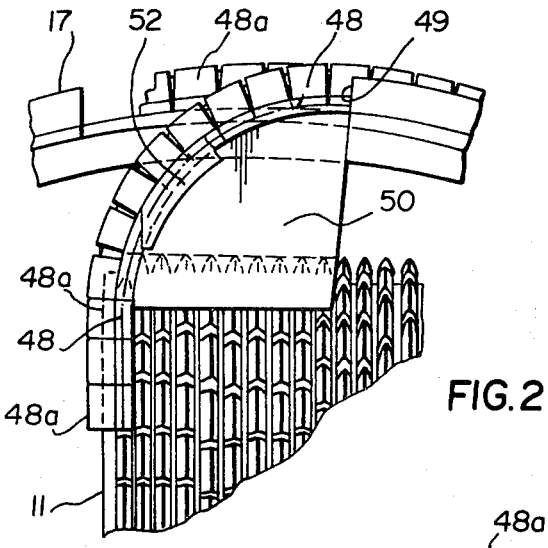
FIG. 2 is a partial view in the direction of arrow A in FIG. 1, showing faired cable fully wound on the second drum and partially wound on the first drum.
Figure 3:
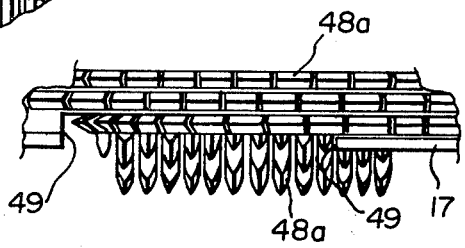
FIG. 3 is a view at right angles to arrow A and is a partially unsectioned view of the embodiment of FIG. 1, showing faired cable fully wound on the second drum and partially wound on the first drum.

(ii) Description of FIGS. 2 and 3

As seen in FIGS. 2 and 3, cable 48 having fairings 48*a* is fully wound both on inner drum 11 and outer drum 17. Outer drum 17 has a notch 49 at the free end thereof and contains a cable spout or ramp 50 with guard 52 thereon just below the notched-out section 49.

Figure 4:
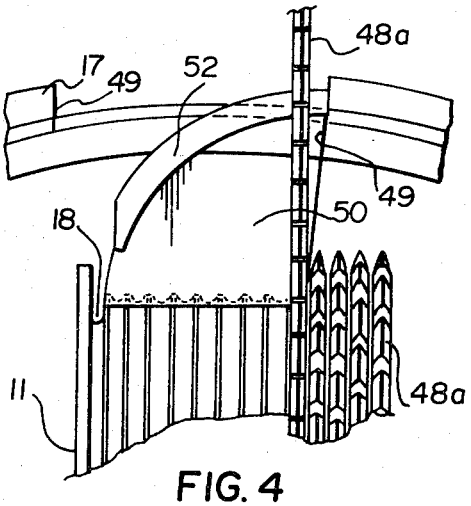
FIG. 4 is a view similar to that in FIG. 2, showing faired cable partially wound on the second drum.
Figure 5:
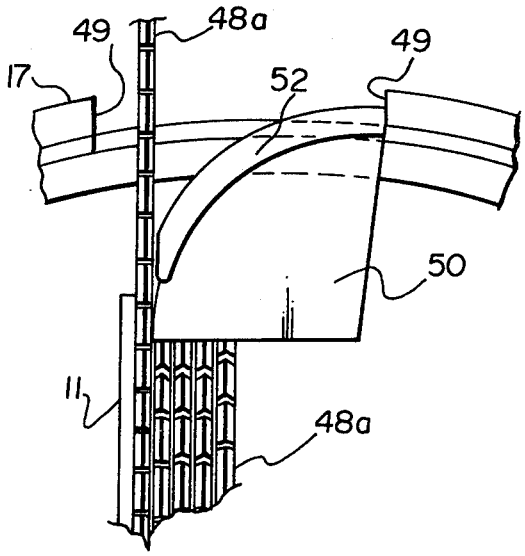
FIG. 5 is a view similar to that in FIG. 2, showing faired cable fully wound on the second drum and about to be wound on the first drum.

(iii) Description of FIGS. 4 and 5

As seen in FIG. 4, the cable 48 and fairing nosepieces 48*a* just clear the free end of the outer drum 17. As seen in FIG. 5, the cable 48 is seen to be disposed in the notch 49 of the outer drum 17 just clear of guard 52 and spout or ramp 50.

It is important to ensure that there is enough room for bevel gear 22 inside drum 17. If not, then it may be necessary to replace gears 22 and 23 with a multiple gearset consisting of a combination of smaller parallel and bevel gears.

(iv) Description of FIG. 10

FIG. 10 shows a double conical design which may be used for drums 11 and/or 17, in order to utilize existing space more efficiently. It is seen, for the case of the inner drum assembly, that the inner drum 111 has a double conical outer shell 111*a*, 111*b*, with helical channels 111*c* along the peripheral surface thereof. The drum 111 also has the spiral ramp 118, cable hause hole 119, clamp 120 and electrical exit hole 121, as well as cross-shaft 112 and bevel gear 122.

Operation of Preferred Embodiment With Reference to FIGS. 6–9

Figure 6:
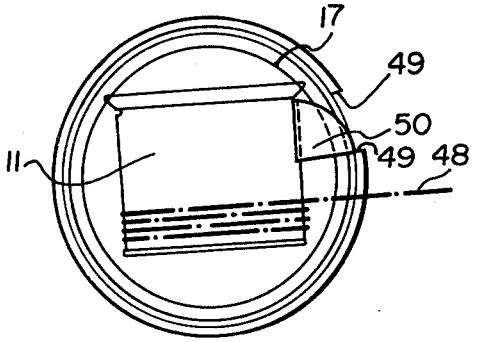

In operation, with all or most of the cable paid out, recovery is achieved as follows:

The piston of hydraulic cylinder 47 is extended, causing linkage 45 to shift multi-purpose clutch lockout coupling 38 to the right (as seen in FIG. 1). This locks out outer drum 17 with spout 50 lined up with spiral ramp 18 by securing drum 17 rigidly to hold-back structure 44 through the engagement of splines 38*a* and 39 and splines 42 and 43. The brake of motor and brake assembly 37 is released and the motor drives the inner drum 11 through gears 35 and 36 and gears 22 and 23 in a direction to heave in the cable. With the cable partially wound on inner drum 11, FIG. 4 shows the appearance of the system with the cable 48 and fairing nosepieces 48*a* just clearing the free end of outer drum 17. This is also shown in FIG. 6.

Figure 7:
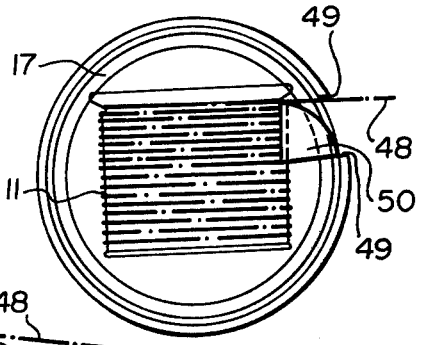

When inner drum 11 has filled up, the cable 48 has settled deeper into outer drum 17 by winding onto spiral ramp 18, and in doing so has dropped into notch 49 of the outer drum 17 just barely clear of spout 50. At this point, the system would have the appearance as shown in FIGS. 5 and 7.

At this point, motor 37 is stopped and the fail-safe brake applied. The piston of hydraulic cylinder 47 is retracted, causing linkage 45 to shift multi-purpose clutch lockout coupling 38 to the left. This causes splines 40 and 41 to engage, locking both drums 11 and 17 together. It also causes splines 42 and 43 to disengage, transferring hold-back action on both drums from structure 44 to the brake of motor and brake assembly 37, but only after the two drums are locked together (i.e., for safety's sake, splines 40 and 41 must "make" before splines 42 and 43 "break"). It will also be essential at this point that either one of the fairing links 48*a* be severed (as shown in FIG. 2) or that extra flexible links be used between a few adjacent fairings in order that the fairings can swivel 90 degrees preparatory to climbing spout 50 for spooling on outer drum 17.

Figure 8:
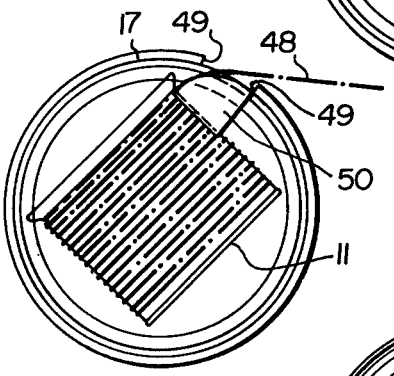
Figure 9:
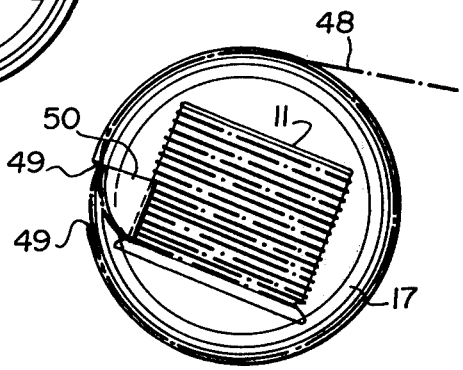

Slowly powering motor 37 in the haul-in direction will now force fairings 48*a* of the cable 48 to ride up slowly on spout 50 to bring the cable up onto outer drum 17 (see FIG. 8). The inner drum 11 is prevented from rotating inside outer drum 17 during spooling of the cable 48 onto the outer drum 17 by virtue of coupling 38 having locked both drums together. Winding now continues until outer drum 17 is filled with cable. FIG. 9 also shows the cable wound on both drums.

Paying out of the cable 48 is achieved by reversing these steps.

When spooling very long lengths of the faired cable onto the compound drum hoist of an embodiment of this invention, the use of a cable winder as described in Canadian Pat. No. 856,639 issued Nov. 6, 1970 becomes impractical, due to the very large size of winder required. It is therefore proposed to lead the electrical core of the cable out hole 21 and to terminate the cable in a special quick-release connector (not shown) which can be connected under deluge conditions on the exposed deck spaces of the ship's stern. Such a connector would contain an extra circuit to prevent hoist rotation with the tow cable connected to the ship's cable, except for local over-ride for fractional drum turns.

SUMMARY

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

What I claim is:

1. A compound drum hoist comprising:

(a) a first outer cable-spooling drum rotatably and drivingly mounted on a first shaft;

(b) a second inner cable-spooling drum nested within said first drum, and rotatably and drivingly mounted on a second shaft disposed at an angle of $90° \pm 30°$ to said first shaft;

(c) means for rotating said inner drum while keeping said outer drum stationary, thereby to spool faired cable onto said inner drum;

and (d) means for substantially simultaneously rotating said outer drum along with said inner drum, thereby to spool faired cable onto said outer drum.

2. A compound drum hoist comprising:

(a) a first outer cable-spooling drum rotatably and drivingly mounted on a first shaft;

(b) a second inner cable-spooling drum nested within said first drum, and rotatably and drivingly mounted on a second shaft disposed at right angles to said first shaft;

(c) means for rotating said inner drum while keeping said outer drum stationary, thereby to spool faired cable onto said inner drum;

and (d) means for substantially simultaneously rotating said outer drum along with said inner drum, thereby to spool faired cable onto said outer drum.

3. The compound drum hoist of claim 2 wherein said inner drum comprises a cylindrical drum rotatably mounted on a cross-shaft supported on bearings within the shell of the outer drum.

4. The compound drum hoist of claim 3 wherein said inner drum is driven by a multiple gear set.

5. The compound drum hoist of claim 3 wherein said inner drum is driven by a bevel gear, meshing with a bevel pinion mounted on, or formed integral with, a drive shaft.

6. The compound drum hoist of claim 5 wherein said drive shaft is driven by a bull gear secured thereto, and driven by a pinion which in turn is driven by a motor.

7. The compound drum hoist of claim 6 wherein said motor includes a fail-safe brake.

8. The compound drum hoist of claim 2 wherein said inner drum includes a spiral ramp at one end and a cable hause hole, a clamp and an electrical exit hole at the other end thereof.

9. The compound drum hoist of claim 2 wherein said inner drum comprises a double conical drum rotatably mounted on a cross-shaft supported on bearings within the shell of the outer drum.

10. The compound drum hoist of claim 9 wherein said inner drum includes a spiral ramp at one end and a cable hause hole, a clamp and an electrical exit hole at the other end thereof.

11. The compound drum hoist of claim 5 wherein the gear drive shaft to said inner drum is supported on bearings mounted on a hub extending from a radial web of said outer drum.

12. The compound drum hoist of claim 11 wherein said outer drum comprises a cylindrical drum.

13. The compound drum hoist of claim 11 wherein said outer drum is supported on bearings on a rim extension mounted in an outer housing, and on bearings on a hub thereof mounted on an inner housings, said housing being attached to a base.

14. The compound drum hoist of claim 11 wherein said gear drive shaft is driven by a bull gear secured thereto, and driven by a pinion which itself is driven by a motor.

15. The compound drum hoist of claim 14 wherein said outer drum is selectively driven by the same said bull gear which is secured to said gear drive shaft, and is driven by a pinion which itself is driven by a motor which in turn drives said inner drum.

16. The compound drum hoist of claim 2 wherein said means for rotating said outer drum and said inner drum includes means for positively locking the inner drum to the hub of the outer drum before said drive means for said outer drum can be driven.

17. The compound drum hoist of claim 15 wherein said means for rotating said outer drum and said inner drum comprises a clutch lockout coupling selectively actuatable to cause (a) either the inner drum alone, or (b) both the inner drum and the outer drum to be driven together.

18. The compound drum hoist of claim 17 wherein said clutch lockout coupling includes external splines adapted to be in constant engagement with internal splines on the hub of the outer drum; internal splines adapted selectively to engage external splines in said drive shaft for the inner drum; external splines adapted to engage internal splines in a hold back structure; and an actuatable yoke linkage to cause the splines in the clutch lockout coupling to engage respective splines, thereby to cause said (a) either the inner drum alone, or (b) both the inner drum and the outer drum to be driven together.

19. The compound drum hoist of claim 18 further including a hydraulic cylinder for actuating said yoke linkage.

20. The compound drum hoist of claim 12 wherein said outer drum includes a notched portion and a spout or ramp with a guard thereon just below the notched portion, thereby to guide faired cable between the inner drum and the outer drum.

* * * * *

UNITED STATES PATENT AND TRADEMARK OFFICE

CERTIFICATE OF CORRECTION

PATENT NO. : 4,312,496

DATED : January 26, 1982

INVENTOR(S) : Robert S. Norminton

It is certified that error appears in the above—identified patent and that said Letters Patent is hereby corrected as shown below:

Column 7, line 36, "housings" should read --housing--.

Column 7, line 36, "housing" should read --housings--.

Signed and Sealed this

*Thirty-first* Day of *August 1982*

[SEAL]

*Attest:*

GERALD J. MOSSINGHOFF

*Attesting Officer*

*Commissioner of Patents and Trademarks*